US005501548A

United States Patent [19]

Hayashi et al.

[11] Patent Number: 5,501,548

[45] Date of Patent: Mar. 26, 1996

[54] METHOD FOR CONTROLLING THE DIRECTION OF A SHIELD TUNNELING MACHINE AND AN APPARATUS THEREFOR

[75] Inventors: Mitsutoshi Hayashi, Ohmiya; Akitaka Fujita, Tokyo; Shingo Nagashima, Tokyo; Isao Fujimori, Higashimurayama, all of Japan

[73] Assignees: Tokyo Gas Co., Ltd.; Kabushiki Kaisha Iseki Kaihatsu Koki, both of Tokyo, Japan

[21] Appl. No.: 201,332

[22] Filed: Feb. 24, 1994

[30] Foreign Application Priority Data

Mar. 22, 1993 [JP] Japan ..... 5-085111

[51] Int. Cl.[6] ..... E21D 9/00; E21D 9/06

[52] U.S. Cl. ..... 405/143; 299/1.4; 299/1.8; 405/138; 405/146

[58] Field of Search ..... 405/143, 138, 405/141; 299/1.05, 1.1–1.9, 31, 32; 33/1 M; 342/135

[56] References Cited

U.S. PATENT DOCUMENTS

| | | | |
|---|---|---|---|
| 4,311,411 | 1/1982 | Akesaka et al. | 405/143 X |
| 5,135,326 | 8/1992 | Mitani et al. | 299/31 X |
| 5,186,579 | 2/1993 | Hanamoto et al. | 299/1.4 X |
| 5,296,915 | 3/1994 | Akesaka | 356/400 |
| 5,330,292 | 7/1994 | Sakanishi et al. | 342/135 X |

*Primary Examiner*—Dennis L. Taylor
*Attorney, Agent, or Firm*—Townsend & Banta

[57] ABSTRACT

When a shield tunneling machine is deviated from the scheduled line while being propelled, the deviation of the shield tunneling machine from the scheduled line is detected and according to the data obtained on the deviation of the shield tunneling machine from the scheduled line, the propelling direction of the shield tunneling machine is automatically controlled.

2 Claims, 4 Drawing Sheets

METHOD FOR CONTROLLING THE DIRECTION OF A SHIELD TUNNELING MACHINE AND AN APPARATUS THEREFOR

BACKGROUND OF THE INVENTION

1. Field of the Invention

The present invention relates to a method of controlling the propelling direction of a shield tunneling machine used in the pipe-jacking process, and an apparatus therefor.

2. Description of the Prior Art

The semi-shield process is applied for laying a conduit for sewerage or service water, wherein a shield tunneling machine is arranged, and the shield tunneling machine and Hume pipes following the shield tunneling machine are propelled by a pipe-jacking machine. In the semi-shield process, laser beam is sent along a scheduled line on which a conduit is to be laid, the shield tunneling machine and a plurality of pipes are propelled along the laser beam by the pipe-jacking machine, while the ground is excavated by the shield tunneling machine.

When the shield tunneling machine is propelled, a variety of resistances are applied on the shield tunneling machine. Therefore, it happens that the propelling direction of the shield tunneling machine is deviated from the scheduled line. In order to control the propelling direction of the shield tunneling machine, the shield tunneling machine is provided with a target on which a laser beam is projected, with a television camera by which an image of the target is taken, and with a pointer wherein a forward end of the pointer is attached to a cutter head of the shield tunneling machine and a rear end of the pointer is disposed by the surface of the target.

An image of a laser spot projected on the target is taken by the television camera. The image of a laser spot projected on the target is projected on a Braun tube and observed by an operator. When it is checked the projecting direction of the shield tunneling machine is deviated from the scheduled line, a directional control means, that is, jacks are controlled so that the cutter head is turned against the tail shield by which the direction of the shield tunneling machine is adjusted according to the movement of the pointer which corresponds to the orientation of the cutter head and the tail shield and an angle between the cutter head and the tail shield.

In the shield tunneling machine, the target is mounted at a certain place in the shield tunneling machine. The shield tunneling machine is propelled by a pipe-jacking machine disposed in a start vertical shaft, while a laser beam is sent from a laser beam source disposed in the start vertical shaft to the target. A spot of laser beam projected along the scheduled line on the target is made the origin on the target, and when the spot on the target, while the shield tunneling machine is projected, is displaced from the origin to the another place, it is found only that the section of shield tunneling machine is displaced from the scheduled line corresponding to the position of the spot of laser beam projected on the target, from an image of Braun tube.

Accordingly, from the observation of a spot of laser beam on the target which is displaced from one origin to another origin, it is difficult to find a control amount of the directional control means. Therefore, at present, the directional control of shield tunneling machine demands skill of an operator and his know-how.

Recently, a shield tunneling machine was developed in which a laser beam is sent along a scheduled line to a target, which is pervious to light, and a laser beam passing through the target is reflected by a reflector. The reflected laser beam by the reflector is projected on a screen, and the advanced direction of the shield tunneling machine can be controlled by observing a spot of laser beam projected on the target and a spot of laser beam protected on the screen. In the shield tunneling machine, the displacement of the spot of laser beam projected on the screen, while the shield tunneling machine is advanced, from the original spot of a laser beam projected on the screen is detected by observing the screen, and the advanced direction of the shield tunneling machine is controlled corresponding to the detected displacement of spot of laser beam.

BRIEF SUMMARY OF INVENTION

It is an object of the present invention to provide a method of controlling effectively and automatically the advanced direction of a shield tunneling machine.

It is a second object of the present invention to provide a shield tunneling machine by which it is possible to adjust automatically the advanced direction of a shield tunneling machine.

In order to achieve the first object, the present invention is characterized in that in a method of controlling the direction of a shield tunneling machine having a cutter head provided with a cutter for excavating the ground, and with a tail shield connected through directional control means with the cutter head, the method comprises the steps of sending a laser beam of light along the scheduled line for laying a conduit; projecting the beam of light on a target provided within the tail shield, thereafter reflecting the beam of light on a reflector provided on the cutter head and projecting the reflected beam of light to a screen provided with the tail shield; taking an image of the target and the screen by television camera; and when it is observed that a spot of beam of light projected on the screen is displaced from the original point to another point while the shield tunneling machine is propelled, controlling the directional control means so that the spot of beam of light projected on the screen is made to coincide with the original point.

In order to achieve the second object of the present invention, the present invention is characterized in that the directional control apparatus comprises: a cutter head provided with a cutter for excavating the ground and with a reflector for reflecting a beelining beam of light; a tail shield articulated through a directional control means with the cutter head, and provided with a target on which the beam of light is projected and which is pervious to the beam of light, with a screen on which the beam of light reflected by the reflector provided on the cutter is projected, and with a television camera for taking an image of the target and the screen; an image processor for processing the image taken by the television camera by which the position of the spot on the target and the screen is detected; a memory in which the position of the original spots of beam of light projected on the target and the screen, respectively, measured at the beginning of propelling shield tunneling machine is stored; a comparator in which a position of the present spot of beam of light projected on the screen during the propulsion of the shield tunneling machine is compared with the position of the original spot of beam of light projected on the screen, and when it is detected that the present spot of beam of light projected on the screen is displaced from the original spot of beam of light to another place, a signal corresponding to the displacement of the spot from the original spot to another place is generated; an actuator for actuating the directional control means by which the directional control means is operated so that the present spot of beam of light projected on the screen is made to coincide with the original spot.

According to the present invention, when beginning to propel the shield tunneling machine, a spot of beelining beam of light, for example, laser beam, projected on the screen is defined as the origin on the screen. When the shield tunneling machine is deviated from the scheduled line while the shield tunneling machine is advanced, the displacement of the shield tunneling machine is accompanied by the spot of laser beam projected on the screen being displaced from the origin to another place. Therefore, when the displacement of the spot of beam of light projected on the screen from the origin to another is detected, the propelling direction of the shield tunneling machine can be adjusted by operating the directional control means so that the spot of beam of light projected on the screen is made to coincide with the origin.

When the shield tunneling machine is deviated from the scheduled line, the deviation of the shield tunneling machine from the scheduled line is accompanied by the spot of beam of light projected on the target and the spot of beam of light projected on the screen being displaced from the origin to another place on the target and the origin to another place on the screen, respectively. The direction of displacement of the spot of beam of light projected on the target from the origin to another place on the target and the direction of the displacement of the spot of beam of light projected on the screen from the origin to another place on the screen are opposite to the direction of the deviation of the shield tunneling machine from the scheduled line. Namely, when the shield tunneling machine is deviated upward of the scheduled line, the spot of beam of light projected on the target and the spot of beam of light projected on the screen are moved downward from the origin on the target and the origin on the screen. Therefore, when the spot of beam of light projected on the target and the spot of beam of light projected on the screen are displaced from the origin to another place on the target and the origin to another place on the screen, respectively, with the propulsion of the shield tunneling machine, it can be found that the shield tunneling machine is advanced with being deviated from the scheduled line.

When the cutter head is turned against the tail shield tunneling machine, the reflector is inclined in the opposite direction to the turning direction of the cutter head turned with turning the cutter head against the tail shield, so that the spot of beam projected on the screen is moved to approach the origin on the screen. Therefore, when the directional control means is operated in such a manner that the spot of beam of light projected on the screen is made to coincide with the origin on the screen, according to the operation of the directional guide means, the cutter head is turned against the tail shield, the front end of the cutter head is directed toward the scheduled line.

Therefore, the shield tunneling machine is directed to approach the scheduled line. With the shield tunneling machine approaching the scheduled line, the spot of beam of light projected on the target is moved to approach the origin on the target. Further, the directional control means are operated so that the spot of beam of light projected on the screen is made to coincide with the origin on the screen. When an angle between the cutter head and the tail shield is reduced, the shield tunneling machine approaches slowly toward the scheduled line. By repeating the operation, the propelling direction can be adjusted to approach the scheduled line.

According to the above-mentioned directional control apparatus, when the shield tunneling machine is deviated from the schedule line with the propulsion of the shield tunneling machine, the deviation can be automatically adjusted. Namely, a laser beam sent in parallel with the scheduled line is projected on the target and passed through the target and the laser beam passed through the target is reflected toward the screen by the reflector and projected on the screen.

Accordingly, the original points, that is the origin on the target and the origin on the screen can be stored by the following method; the shield tunneling machine is disposed on the pipe-jacking machine in which the axis of the cutter head coincides with the axis of the tail shield, and under this condition, the laser beam is projected on the target and on the screen, an image of the target and the screen is taken by the television camera, the taken image is processed by the image processor, and the positions of the spot of laser beam projected on the target and the spot of laser beam projected on the screen are processed and stored in the memory.

With the propulsion of the shield tunneling machine, an image of the target and the screen is continuously taken and the present position of the spot of laser beam projected can be detected continuously. Further, by comparing the detected position with the origin on the screen by the comparator so that existence of the displacement of the spot of laser beam from the origin to another place, the direction of displacement thereof and the amount of displacement are detected, and a signal can be generated according to the direction of displacement and the amount of displacement.

Then, by operating the directional control means by the actuator according to the signal outputted from the comparator, the cutter head is turned against the tail shield so that the present spot of laser beam projected on the screen coincides with the origin on the screen, by which the front end of the cutter head can be adjusted to coincide with the scheduled line. Accordingly, under this condition, the shield tunneling machine is propelled and when the spot of laser beam projected on the screen is displaced from the origin to another place on the screen, the directional control means is operated so that the spot of laser beam projected on the screen coincides with the origin on the screen, by which the shield tunneling machine approaches the scheduled according to the propulsion of shield tunneling machine.

DETAILED DESCRIPTION OF THE PREFERRED EMBODIMENT

An embodiment of a directional control device and a method of controlling a direction of a shield tunneling machine are explained.

Figure 1:
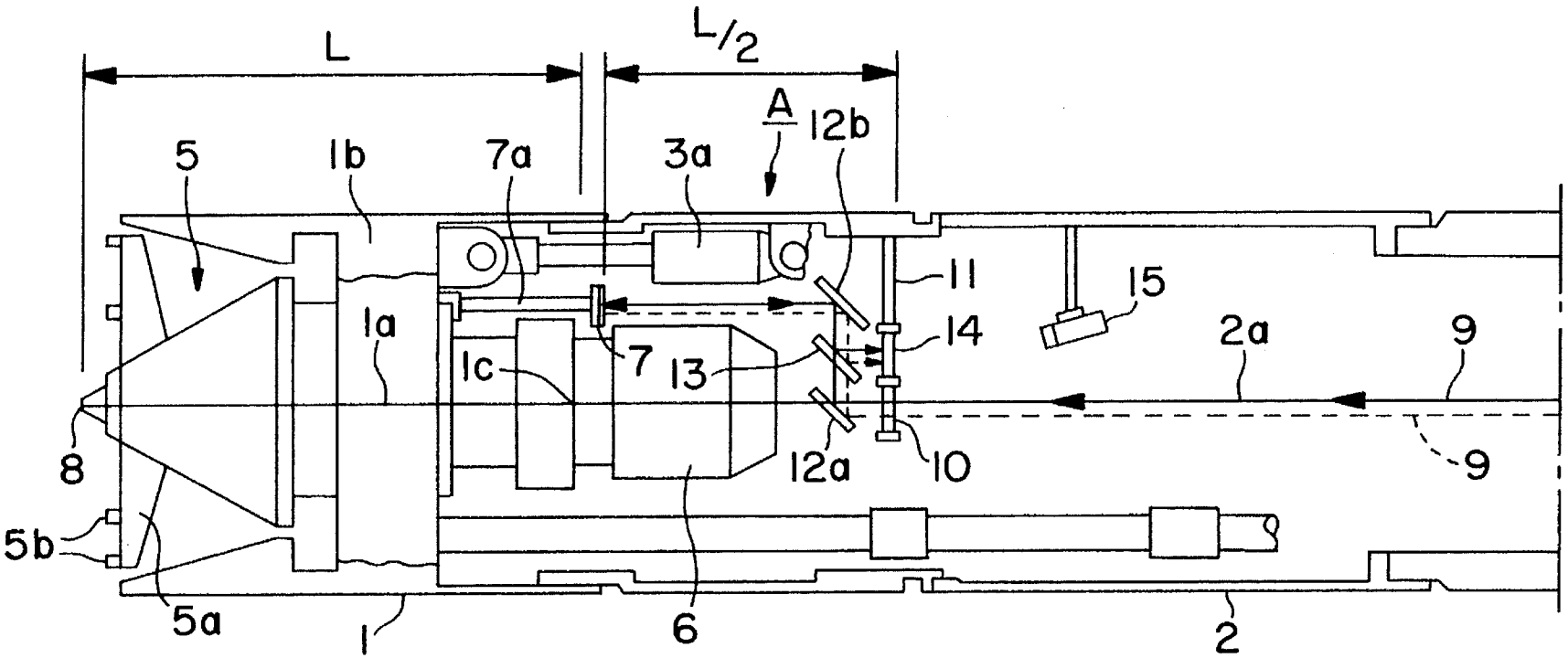
FIG. 1 is a sectional view of a shield tunneling machine.

Referring to FIG. 1, shield tunneling machine A comprises a cutter head 1 arranged at the head in the advancing direction thereof (the left side in FIG. 1) and tail shield 2 (the right side in FIG. 1) following cutter head 1. Cutter head 1 is connected through two jacks 3*a* and 3*b* and one rod 4 with tail shield 2. The front end of tail shield 2 is engaged with the rear end of cutter head 1 so that cutter head 1 can be turned against tail shield 2 by actuating at the same time jacks 3*a* and 3*b* or by actuating selectively jack 3*a* or jack 3*b*.

Cutter head 1 is formed with partition 1*b*, by which the inside of shield tunneling machine A is divided into a first area on the ground side and a second area on the interior side. Cutter is provided within the first area for excavating the ground. Motor 6 for driving cutter 5 mounted on cutter head 1 and reflector 7 are provided within the second area on the interior. Reflector 7 is secured to an end of arm 7*a* which other end is secured to partition 1*b* at a given distance from an axis 1*a* of cutter head 1.

Cutter 5 is provided with a plurality of spokes 5*a* to which a plurality of bits 5*b* are secured. A reference point 8 into which shield tunneling machine A is controlled is set at the front end of cutter 5 on the axis 1*a* of cutter head 1, wherein a distance between reference point 8 and a turning point 1*c* on which cutter 5 is turned against tail shield 2 is set to a given amount L. In the present embodiment, a beelining laser beam which goes straight is used, wherein the laser beam is sent along a scheduled line. Therefore, while shield tunneling machine A is advanced on the scheduled line, laser beam 9 is sent along the axis 2*a* of tail shield 2.

Target 10 is provided within tail shield 2 on the axis 2*a* of tail shield 2 and behind reflector 7. Target 10 is secured to a stay 11 secured to an inner wall of tail shield 2. Reflector 7 is disposed at a distance from the axis 2*a* of tail shield 2 within tail shield 2. In order to lead laser beam 9 to reflector 7, a pair of mirrors 12*a*, 12*b* are disposed between target 10 and reflector 7.

Mirrors 12*a*, 12*b* are formed of reflectors by which a laser beam is perfectly reflected. Mirror 12*a* is disposed on the axis 2*a* of tail shield 2 before target 10 and at an angle of 45 degrees with regard to the axis 2*a* of tail shield. Mirror 12*b* is opposed to mirror 12*a* and reflector 7, and at an angle of 45 degrees with regard to the axis 2*a* of tail shield 2 ahead of target 10 between target 10 and reflector 7.

One-way mirror 13 is disposed at an angle 45 degrees with regard to the axis 2*a* of tail shield 2 between mirrors 12*a*, 12*b*. Screen 14 is opposed with one-way mirror 13. One-way mirror 13 transmits laser beam 9, which travels to reflector 7, and reflected light from reflector 7 is sent to screen 14, which is adjacent to target 10 and attached to stay 11.

In the above-mentioned construction, the size which is the distance of between reflector 7 and mirror 12*b* plus the distance between one-way mirror 13 and screen 14 is set to be ½ of the length L between reference point 8 of cutter head 1 and turning point 1*c* or more.

Television camera 15 for taking an image of target 10 and screen 14 is provided at a given position within tail shield 2. Television camera 15 takes at the same time images of target 10 and screen 14, and image receiver 21 (mentioned hereinafter ) reads out the image.

Figure 2:
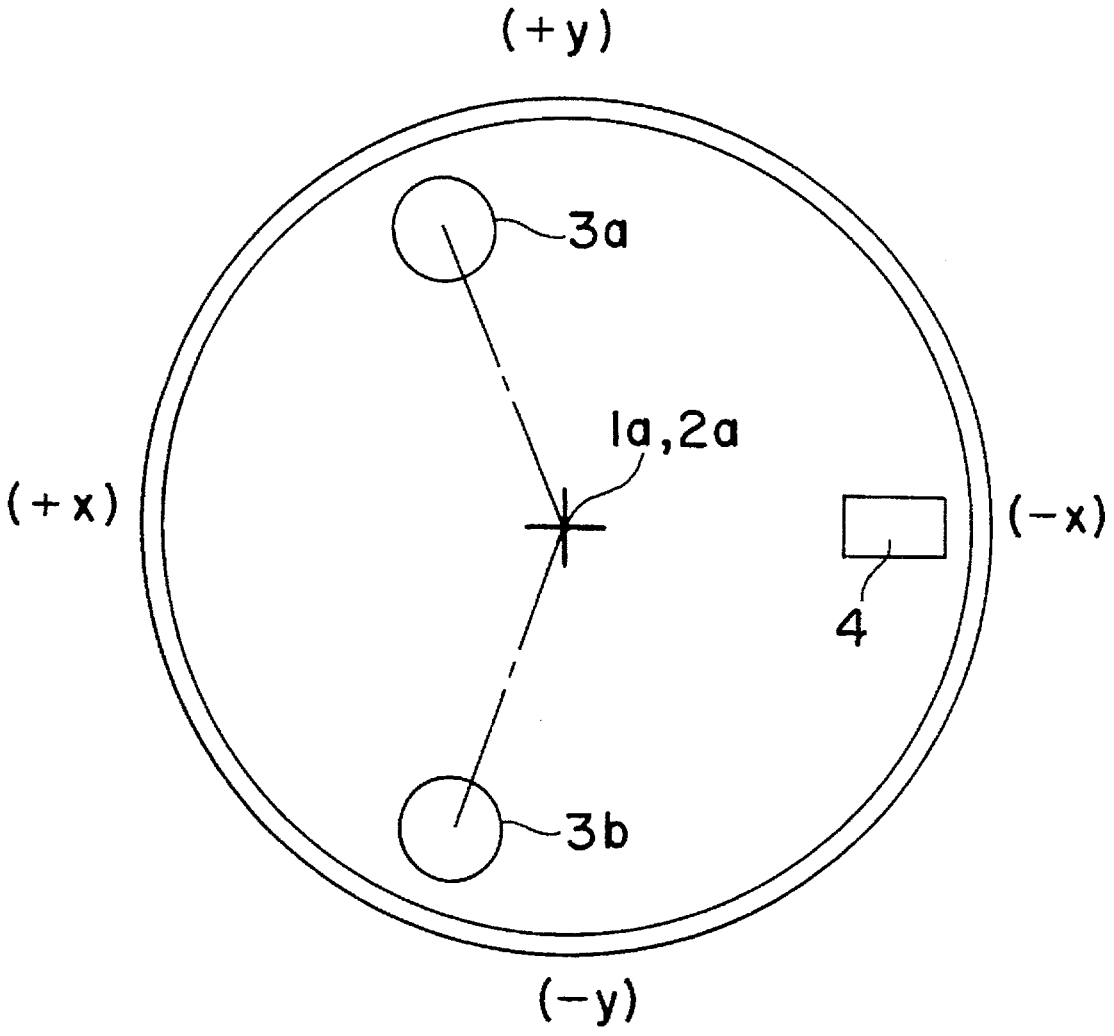
FIG. 2 is a schematic illustration of a directional control means.

Directional control means for controlling the advancing direction of shield tunneling machine A by turning relatively cutter head 1 against tail shield 2, which is shown in FIG. 2, comprises two jacks 3*a*, 3*b* and one rod 4, which are arranged in the circumferential direction of shield tunneling machine A. with a distance. Jacks 3*a* and 3*b* are formed of hydraulic cylinders. Rod 4 is connected through a pin and the like (not shown ) with cutter head 1, and connected through a pin and a universal joint with tail shield 2.

Accordingly, it is possible to turn cutter head 1 against tail shield 2 at a desired angle between cutter head 1 and tail shield 2 by extending and contracting jack 3*a* and / or jack 3*b* by supplying a desired amount of hydraulic oil to jack 3*a* and / or jack 3*b*. With cutter head 1 turning against tail shield 2, reference point 8 moves in a circle with radius which is a distance L between reference point 8 and turning point 1*c* on turning point 1*c* which is set on the axis 1*a* of cutter head 1.

Actuating means for actuating Jacks 3*a*, 3*b* comprise a hydraulic unit for generating hydraulic oil with a set pressure and hydraulic circuits for controlling a desired amount of hydraulic oil supplied to desired chambers of jack 3*a* and jack 3*b*, wherein the hydraulic circuits are conventional hydraulic circuits including directional cut off valve ( not shown ), pilot check valve, relief valve and others.

Figure 3:
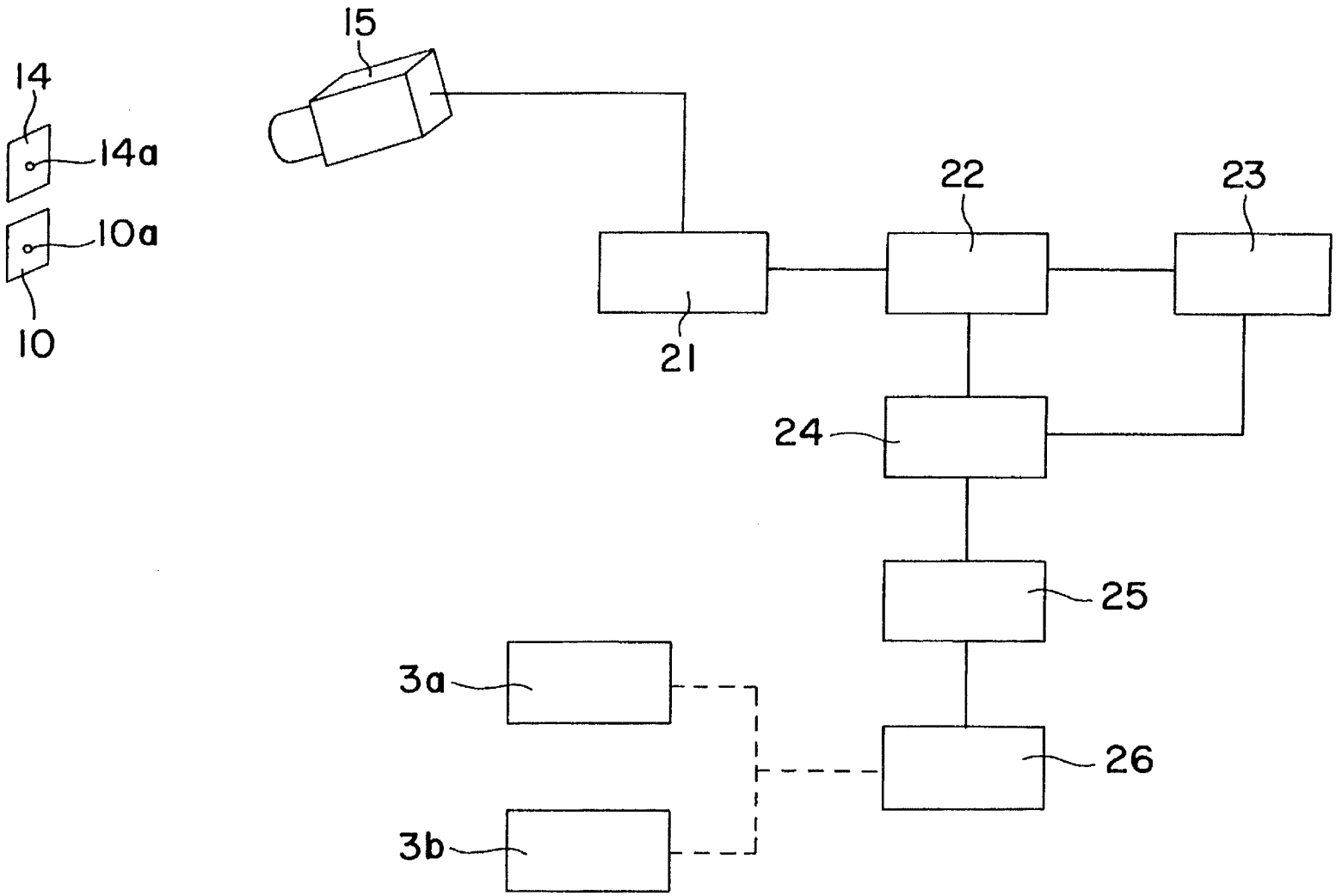
FIG. 3 is a block diagram of a control system.

Then, referring to FIG. 3, a control system of shield tunneling machine A is explained.

Television camera 15 is connected with image receiver 21. Image receiver 21 is composed of an image receiving part formed in the same manner as a conventional television image receiver and a color separation part for separating a certain color, wherein the image of target 10 and screen 14 is displayed in the image receiving part, while color signal, for example, R signal in cases where the color of laser beam is red, or G signal in cases where the color of laser beam is green, is separated from the information of images (hereinafter it is called "laser spot") 10*a*, 14*a* of laser beam projected on target 10 and screen 14, which is transmitted to image processor 22.

In image processor 22, coordinates of color signal, for example, R signal transmitted from image receiver 21 are operated, wherein the image processor is a conventional image processor. Image processor 22 is connected with image processing control unit 23 including memory, controlling circuit and other, wherein coordinates data of the original projected spots, that is, coordinate data of the origin on target O and the origin on screen o are gained from the information of images (FIG. 4) on target 10 and screen 14 when beginning to propel shield tunneling machine A are stored in image processing unit 23 and coordinates data of the origin on target O, and the origin on screen o which are stored while propelling shield tunneling machine A are outputted from image processing unit 23 to comparator 24.

Further, after the propulsion of shield tunneling machine A has begun, a hold signal and a scene switching signal are periodically transmitted from image processing unit 23 to image processor 22. The information of images of target 10, and screen 14 are suitably changed according to the generation of the respective signals and held, and coordinates data of laser spots 10*a*, 10*b* when propelling shield tunneling machine are operated from the held image and operated data are transmitted to comparator 24.

Coordinates data of the origin on target O and the origin screen o are transmitted from processing control unit 23 to comparator 24, and coordinate data of laser spots 10*a*, 14*a* while propelling shield tunneling machine A are transmitted from image processor 22 to comparator 24, wherein the respective data are compared with each other by which a direction and amount of displacement of laser spots 10*a*, 10*b* from the origin 0, 0 to another place and are detected so that whether shield tunneling machine A is deviated from a scheduled line (laser beam 9) or not is detected. When it is found that laser spots 10*a*, 14*a* are moved at a given distance or more from the origin on target O and the origin on screen o, an operation signal is generated according to the displacements of laser spots 10*a* and 14*a*, and transmitted through interface 25 to actuator 26.

Operation signal generated from comparator 24 is a signal for turning cutter head 1 against tail shield 2 so that laser spot 14*a* on screen 14 coincides with the origin on screen o, and a signal for selecting chambers of jack 3*a* and /or jack 3*b* and determining the amount of hydraulic oil which is supplied to selected chambers.

In actuator 26, a hydraulic circuit (not shown) is actuated according to transmitted operation signal by which a given amount of hydraulic oil is supplied to jacks 3*a*, 3*b* so that jacks 3*a*, 3*b* are moved with regard to tail shield 2. A tilted angle of reflector 7 is changed according to the movement of cutter head 1 against tail shield 2. Laser beam 9 is reflected on reflector 7 with an angle which is equal to two times as many as the change of angle of reflector 7, and projected through mirror 12*b* and one-way mirror 13 to screen 14. Laser spot 14*a* approaches the origin on screen o with the movement of cutter head 10 against tail shield 2.

Then, a process of controlling a propelling direction of the above-mentioned shield tunneling machine A. First, shield tunneling machine A is disposed on a pipe-Jacking machine mounted in a start vertical shaft ( not shown ) along the scheduled line. Then laser beam 9 is sent along a scheduled line from the rear of shield tunneling machine A, and projected on target 10 and on screen 14. The image taken by television camera 15 is processed by image processor 22, and the original projected spots are stored as the origin on target O and the origin on screen o in image processing control unit 23.

Figure 4:
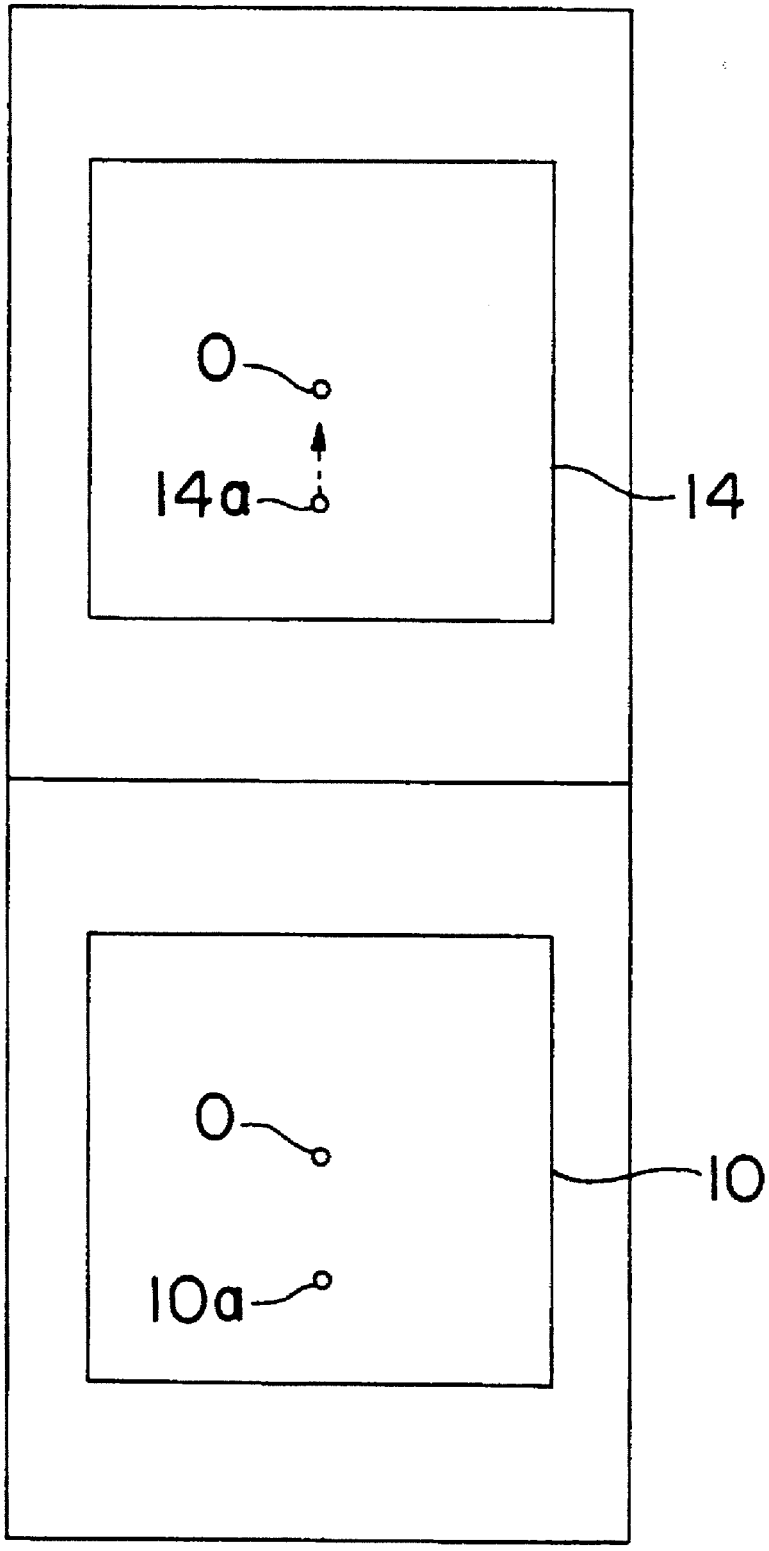
FIG. 4 is a schematic representation for showing an image of a target and a screen.

Thereafter, the ground is excavated by cutter 5, while shield tunneling machine A is propelled by the pipe-jacking machine. In the propelling process, if shield tunneling machine A shifts upward from the scheduled line while being propelled, laser beam 9 travels relatively downward with regard to the axis 2*a* of tail shield 2 as shown by the dotted line in FIG. 1, wherein laser spot 10*a* on target 10 and laser spot 14*a* on screen 14 are moved below the origin on target O and the origin on target o as shown in FIG. 4, respectively. Namely, a direction of displacement of spots 10*a* and 14*a* is reverse to a direction of shift of shield tunneling machine A from the scheduled line.

The displacement of laser spots 10*a*, 14*a* from the origin on target O and the origin on screen o on target 10 and screen 14 is observed at intervals of time by image processor 22, image processing control unit 23 and comparator 24. In the present embodiment, immediately after laser spot 14*a* on screen 14 has been moved from the origin on screen o to another place, an operation signal is not generated. A certain buffer zone is provided between the displacement of laser spot 14*a* and the generation of operation signal. Therefore, in case where the displacement of laser spot 14 from the origin on screen o to another place is within the buffer zone, operation signal is not generated so that even if shield tunneling machine A shifts the scheduled line, the propelling direction is maintained.

In the case where laser spot 14*a* on screen 14 is moved beyond the buffer zone from the origin on screen o to another place, operation signal is transmitted from comparator 24 to actuator 26 so that jacks 3*a*, 3*b* are actuated at the same time or selectively according to the direction of turning cutter head 1 against tail shield 2. Namely, when shield tunneling machine A shifts above the scheduled line, hydraulic oil is supplied to jack 3*a* and jack 3*b* so that a rod of jack 3*a* is extended forward, while a rod of Jack 3*b* is contracted.

Cutter head 1 is directed downward toward the scheduled line according to the actuation of jacks 3*a*, 3*b*. With cutter head 1 turning against the tail shield 2, 3*b*, reflector 7 is tilted upward. Therefore, laser beam 9, which is projected on reflector 7, is reflected upward and travels through mirror 12*b* and one-way mirror 13 to screen 14 so that laser spot 14*a* on screen 14 approaches the origin on screen o, wherein laser spot 10*a* on target 10 is not changed.

If cutter head 1 is turned downward against tail shield 2 at the angle θ between cutter head 1 and tail shield 2 corresponding to operation signal from comparator 24, reflector 7 is tilted upward at an angle of θ. Accordingly, an angle between laser beam 9 projected on reflector 7 and the reflected light therefrom is 2θ. Since a distance between reflector 7 and screen 14 is set to be ½ of turning radius L of cutter head 1 (a distance between reference center 8 and turning center 1*c*), the displacement of reference center 8 when cutter head 1 is macroscopically equal to the displacement of spot 14*a* on screen 14.

Namely, when shield tunneling machine A deviates at a distance d from a scheduled line, laser spot 10*a* on target 10, and laser spot 14*a* on screen 14 are moved at the distance d from the origin on target O and the origin on screen o, respectively. Assuming that laser spot 14*a* on screen 14 coincides with the origin on screen o, when cutter head 1 is turned for an angle of θ against tail shield, equation: $d=L \tan 2\theta/2$ exists. Since $\tan 2\theta=2\tan \theta/(1-\tan^2\theta)$, when θ is an extremely small amount, it may be justifiable that $\tan^2\theta=0$. Therefore, $\tan 2\theta=2\tan \theta$, and $d=L\tan \theta$.

Reference point 8 is moved toward the scheduled line for $L\tan \theta$ by turning cutter head 1 for an angle of θ against tail shield 2. The moved distance $L\tan \theta$ agrees with d which is the moved distance of shield tunneling machine A from the scheduled line. Therefore, when laser spot 14*a* on screen 14 coincides with the origin on screen o with cutter head 1 being turned against tail shield 2, reference point 8 of cutter head 1 coincides with the scheduled line.

When shield tunneling machine A is advanced with an angle of cutter head 1 against tail shield 2 being maintained, reference point 8 intersects with the scheduled line, while shield tunneling machine A approaches the scheduled line. With shield tunneling machine A approaching the scheduled line, Beam spot 10*a* on target 10 approaches the origin on target O and at the same time laser spot 14*a* on screen 14 is kept apart from the origin of screen o.

In the above-mentioned process, image processing for an image taken by television camera 15 is continued, and in the case where laser spot 14*a* on screen 14 is within the buffer zone, operation signal is not outputted from comparator 24 to actuator 26.

As above-mentioned, when shield tunneling machine A deviates from the scheduled line, cutter head 1 is turned against tail shield 2 in such a manner that laser spot 14*a* on screen 14 coincides with the origin of screen o, by which reference point 8 is made to coincide with the scheduled line so that the advanced direction of shield tunneling machine A can be controlled.

As explained in detail hereinbefore, according to the present invention, a displacement of shield tunneling machine A can be determined by observing the displacement of laser spot projected on target, and the advanced direction of the shield tunneling machine can be controlled by controlling a directional control means so that the laser spot projected on a screen coincides with the origin on a screen, when the displacement of a shield tunneling machine from the scheduled line is generated.

By the directional control apparatus of the shield tunneling machine according to the present invention, when the shield tunneling machine deviated from a scheduled line while being propelled, an image of a target and a screen is taken by a television camera, and the image taken by a television camera is processed by an image processor and laser spot on the target is compared with the origin on a screen by which an operation signal that executes to make a laser spot on the screen coincide with the origin on the screen is generated and the operation signal is transmitted to an actuator for actuating the directional control means by which the advanced direction of the shield tunneling machine can be controlled automatically so that the spot on the screen is made to coincide with the origin on the screen.

What is claimed is:

1. A directional control apparatus comprising:

a cutter head provided with a cutter for excavating the ground and with a reflector for reflecting a laser beam;

a tail shield articulated through a directional control means with the cutter head, and provided with a target on which the laser beam reflected by the reflector provided on the cutter is projected, and with a television camera for taking an image of a target and a screen;

an image processor for separating only the same color signal of said laser beam from the image taken by a television camera by which the position of the spot on a target and a screen is detected;

a memory in which the position of the original spots of a laser beam projected on a target and a screen, respectively, measured at the beginning of a propelling shield tunneling machine is stored;

a comparator in which a position of the present spot of a laser beam projected on a screen during the propulsion of the shield tunneling machine is compared with the position of an original spot of a laser beam projected on a screen, and when it is detected that the present spot of a laser beam projected on a screen is displaced from the original spot to another place of a laser beam, a signal corresponding to the displacement of the present spot from the original spot to another place is generated; and an actuator for actuating the directional control means by which the directional control means is operated so that the present spot of a laser beam projected on a screen is made to coincide with the original spot.

2. A directional control apparatus of claim 1, wherein the directional control means are jacks.

* * * * *